US011772151B2

(12) United States Patent
Larsen et al.

(10) Patent No.: US 11,772,151 B2
(45) Date of Patent: Oct. 3, 2023

(54) FOUNDRY PRODUCTION LINE AND METHOD OF OPERATING SUCH FOUNDRY PRODUCTION LINE

(71) Applicant: DISA Industries A/S, Taastrup (DK)

(72) Inventors: Per Larsen, Søborg (DK); Henrik Wegge, Sorø (DK)

(73) Assignee: DISA INDUSTRIES A/S, Taastrup (DK)

( * ) Notice: Subject to any disclaimer, the term of this patent is extended or adjusted under 35 U.S.C. 154(b) by 76 days.

(21) Appl. No.: 17/610,080

(22) PCT Filed: May 4, 2020

(86) PCT No.: PCT/EP2020/062272
§ 371 (c)(1),
(2) Date: Nov. 9, 2021

(87) PCT Pub. No.: WO2020/229212
PCT Pub. Date: Nov. 19, 2020

(65) Prior Publication Data

US 2022/0219227 A1 Jul. 14, 2022

(30) Foreign Application Priority Data

May 10, 2019 (EP) ..... 19173868

(51) Int. Cl.
*B22C 25/00* (2006.01)
*B22C 19/04* (2006.01)
(Continued)

(52) U.S. Cl.
CPC ..... *B22C 25/00* (2013.01); *B22C 19/04* (2013.01); *B22D 46/00* (2013.01); *B22D 47/02* (2013.01)

(58) Field of Classification Search
CPC ..... B22C 25/00; B22C 19/04; B22D 46/00; B22D 47/02
See application file for complete search history.

(56) References Cited

U.S. PATENT DOCUMENTS 4,137,962 A 2/1979 Pol
5,697,424 A 12/1997 Ferdinandsen et al.
(Continued)

FOREIGN PATENT DOCUMENTS

WO WO 2016/132196 A1 8/2016
WO WO 2017/025266 A1 2/2017

OTHER PUBLICATIONS

International Search Report for PCT/EP2020/062272 dated Jul. 10, 2020.
(Continued)

*Primary Examiner* — Kevin P Kerns
*Assistant Examiner* — Steven S Ha
(74) *Attorney, Agent, or Firm* — Birch, Stewart, Kolasch & Birch, LLP

(57) ABSTRACT

The foundry production line includes a sand moulding machine, a melt pouring device, a shakeout machine, a finishing apparatus, an inspection station and a computer controlled database system. A pattern plate is provided with a sand mould identification device including a plurality of individually adjustable indicator elements adapted to impress an identification pattern in a sand mould part. Each indicator element has rounded edges and indicates a direction. An automatic image detection system includes an imaging device arranged at the inspection station and being adapted to provide a digital image of an individual identification pattern formed in a cleaned casting. The automatic image detection system includes a computer system running a computer program developed by means of machine learn-
(Continued)

ing to analyse the digital image and thereby detect the individual identification pattern.

22 Claims, 10 Drawing Sheets

(51) Int. Cl.
*B22D 46/00* (2006.01)
*B22D 47/02* (2006.01)

(56) References Cited

U.S. PATENT DOCUMENTS

| | | | |
|---|---|---|---|
| 5,894,005 | A | 4/1999 | Steel et al. |
| 7,252,136 | B2 | 8/2007 | Rieke |
| 2018/0036795 | A1 | 2/2018 | Behr et al. |

OTHER PUBLICATIONS

Written Opinion of the International Searching Authority for PCT/EP2020/062272 dated Jul. 10, 2020.

FOUNDRY PRODUCTION LINE AND METHOD OF OPERATING SUCH FOUNDRY PRODUCTION LINE

The present invention relates to a foundry production line including a sand moulding machine, a melt pouring device, and a shakeout machine for breaking apart sand moulds and taking out castings, the sand moulding machine including at least one moulding chamber in which at least one pattern plate is adapted to form a pattern in a sand mould part during compaction of the sand mould part in the moulding chamber, at least one pattern plate being provided with at least one sand mould identification device including a plurality of individually adjustable indicator elements adapted to impress an identification pattern in a sand mould part during its compaction, each individual indicator element being formed at an end of a rotationally arranged cylindrical element, the rotational position of each individual indicator element about an axis of rotation of the corresponding cylindrical element being adjustable by means of an actuator being controlled by a controller adapted to provide each sand mould formed by two sand mould parts with at least one individual identification pattern arranged to form a corresponding individual identification pattern in a resulting casting, the foundry production line including an automatic image detection system adapted to detect the resulting individual identification patterns in the castings, and the foundry production line including a computer controlled database system adapted to store data relating to a number of production variables measured and/or set during production and data relating to the quality of the produced castings.

WO 2016/132196 A1 discloses a method for identifying a cast part, whereby cast parts that are permanently provided with legible information can be produced. For this purpose, an identification element, which, on one side, has an information surface that is provided with information, and, on another side, has a cast part surface that is associated with the cast part and is likewise provided with information, is arranged on a casting mould surface that is associated with a mould cavity of a casting mould, the identification element being arranged in such a way that the information surface is covered, while the cast part surface of the identification element is exposed in the mould cavity. Next, a metal melt is poured into the casting mould, wetting the cast part surface, such that during the pouring or the solidification of the metal melt, a bonded, interlocking or frictional connection of the identification element to the cast part is produced and the information provided on the cast part surface is represented on the associated surface of the cast part in the form of stamp. Finally, the cast part is removed from the casting mould and trimmed in the conventional manner. In an embodiment, the identification element has the form of a metal sheet angle bracket which is fixed during the casting process with one leg sticking to the surface of the casting and another leg protruding from the casting. Both legs are provided with legible information which may, however, after the finishing treatment, become illegible on the protruding leg. In this case, the leg sticking to the finished casting may be removed from the casting and the information provided on that leg is subsequently represented on the associated surface of the cast part in the form of stamp. However, this method implies a further process step of the sand moulding process whereby the identification element is positioned in a sand mould part before assembling two sand mould parts to form a complete sand mould. As a consequence, the production rate will be reduced. Furthermore, the final castings will be provided with protruding identification elements, which may not be acceptable. On the other hand, if the identification marks have to be removed from the finished castings, a further process step is required. In addition, the identification elements required for this method constitute a consumption material which may add considerably to the production costs of the castings.

WO 2017/025266 A1 discloses a sand mould identification device comprising a housing, which has a mould forming surface, in which a plurality of individually adjustable indicator elements are arranged, each of which being surrounded by a frame element, wherein each indicator is connected with a respective actuator arranged in the housing, the actuators being operatively connected to an electronic control for individual adjustment of the indicator elements. Each individually adjustable indicator element has a symmetrical needle form and may be positioned in four different recognisable positions. The illustrated embodiment has six indicator elements resulting in 4.096 different possible combinations. The identification device operates fully autonomously with its own control device and battery and may be provided with a position sensor in order to adjust the indicator elements when the moulding chamber of the sand moulding machine is opened or closed. The impression of the indicator elements in the finished castings may be detected by means of an automatic image recognition system. However, in a modern foundry production line producing up to about 5000 castings per hour, in order to obtain suitable traceability of the produced castings for retrieval of related production and quality data, many more different combinations of the indicator elements are required than what is possible with this device. Although more different combinations could be achieved by providing more indicator elements, the illustrated embodiment having six indicator elements is already too bulky for most commonly occurring castings. Furthermore, with this known device, it is not possible to accurately detect the impressions of the indicator elements in the finished castings having received an industry standard finishing treatment, such as shot blasting. On the other hand, many possible quality issues, such as porosities and sand inclusions, are not readily detectable before the finishing treatment. Furthermore, in order to inspect the castings, at least the sand would have to be removed. As a consequence, standard inspection of castings in a foundry is always carried out after the finishing treatment. However, in reality, with this disclosed device, the identification marks impressed in the castings would only be automatically readable before the finishing treatment of the castings, and therefore the device has very limited applicability.

U.S. Pat. No. 4,137,962 discloses a casting-marking apparatus adapted for incorporation in a permanent foundry pattern of the type used to produce sand moulds for metal casting. The apparatus carries a marking that is impressed in the sand mould and subsequently reproduced on a casting. The apparatus is designed and constructed so that the marking that it carries can be altered from a station remote from the pattern. In the apparatus, the alterable marking is carried by a marking body that is rotated by an air actuated piston. However, in a modern foundry production line many more different combinations of the indicator elements are required than what is possible with this device. Furthermore, with this known device, it is not possible to accurately detect the impressions of the indicator elements in the finished castings having received an industry standard finishing treatment, such as shot blasting.

U.S. Pat. No. 7,252,136 B2 discloses a numbering device for marking moulded cast parts, the device including a plurality of concentric cylinders having indicia disposed on an end thereof, the cylinders being rotatingly indexable to cause the indicia to move as desired to form the desired mark, the mark is then impressed into a sand mould and subsequently reproduced on the cast part. An actuator such as a mechanical device or a source of pressure fluid such as compressed air or a hydraulic system, for example, causes the numbering device to be incrementally moved or indexed one position, or to add one unit to the count. This device has the same disadvantages as mentioned just above.

In a modern foundry production line, foundry quality costs may indeed be very high. For instance, in the production of demanding automotive products, up to 10 percent of the total production costs may be related to the rejection of defective castings. When castings are rejected due to quality issues, many consequential costs may be incurred. The possible causes for rejection must be analysed and production may have to be adapted accordingly, whereby production may be delayed. However, with prior art casting-marking solutions, it has not been possible to link bad quality for individual castings with relevant process parameters. Rather, it has only been possible to link batch-based quality data like percentage of castings defective due to sand inclusions, percentage of castings defective due to porosities, etc. with batch-based process parameters. As a consequence, it has proven very difficult to further reduce quality costs.

The object of the present invention is to provide a foundry production line enabling improved traceability of the produced castings for retrieval of related production and quality data, as compared to known solutions, without adversely affecting the production.

In view of this object, each individually adjustable indicator element is formed with rounded edges and is formed to indicate a direction along a diameter of the corresponding cylindrical element on which it is arranged, the foundry production line includes a finishing apparatus adapted to clean castings and an inspection station for inspection of castings being arranged after the finishing apparatus in a transport direction of the castings, the automatic image detection system includes an imaging device arranged at the inspection station, the imaging device is adapted to provide a digital image of an individual identification pattern formed in a cleaned casting, and the automatic image detection system includes a computer system adapted to run a computer program developed by means of machine learning to analyse the digital image and thereby detect the individual identification pattern of the cleaned casting.

In this way, by providing a digital image of individually adjustable indicator elements having rounded edges and indicating a diametrical direction and detecting the individual identification pattern of the finished, cleaned casting by running a computer program developed by means of machine learning, it is possible to achieve drastically improved traceability of the produced castings without slowing down production or imparting the final castings negatively. The rounded edges and the direction indication of the individually adjustable indicator elements in combination with the detection method of the individual identification pattern which is based on artificial intelligence in the form of machine learning makes it possible to operate with an extremely large number of different combinations for the individual identification patterns of the castings even after the castings have received their finishing treatment. The result is that exceptional traceability of the produced castings for retrieval of related production and quality data may be achieved even when some process parameters are only tested a few times per day, such as for instance manually conducted sand tests. The exceptional traceability of the produced castings is also reflected by the fact that the individual identification patterns of the castings may be detected at any time after the castings have been cleaned in the finishing station. Furthermore, because each individually adjustable indicator element may provide a large number of different detectable combinations, the individual identification pattern on each casting may be very small, because only a limited number of individually adjustable indicator elements may be necessary.

Preferably, the imaging device is adapted to provide a 2D digital image of the individual identification pattern, but an imaging device producing a 3D digital image may also be used. By providing a 2D digital image, the imaging device may for instance be a commercially available digital camera corresponding to the type provided in many cell phones.

The advantages of using such type of digital camera may be low costs and fast speed during scanning.

In an embodiment, the computer system is adapted to validate the correctness of the detected individual identification pattern of the cleaned casting, preferably by providing an estimate of the accuracy of the performed detection of the individual identification pattern. Thereby, if the likelihood of a correctly detected individual identification pattern is low, the detection may be repeated in order to receive a better estimate of the accuracy. In this way, the quality of the data stored in the database may be optimised and the result of an analysis performed on the basis of the data may be better.

In an embodiment, the sand mould identification device includes a number of stationary alignment elements adapted to impress an alignment pattern in a sand mould part during its compaction, and the automatic image detection system is adapted to, before detection of an individual identification pattern in a casting, align the digital image with a reference image of the alignment pattern. In particular when employing 2D digital images, by aligning the digital image with a reference image of the alignment pattern, the automatic image detection of the individual identification pattern in a casting may be improved.

In an embodiment, the rotationally arranged cylindrical elements are arranged side by side along a line, and the stationary alignment elements are arranged asymmetrically about said line. Thereby, the arrangement of the stationary alignment elements may indicate a reading orientation for the impressions provided by the individually adjustable indicator elements and many more possible different combinations may be achieved by the individually adjustable indicator elements.

In an advantageous embodiment, each individual indicator element extends at least 0.5 millimetres, preferably at least 0.7 millimetres, and most preferred at least 0.9 millimetres from the corresponding end of the rotationally arranged cylindrical element.

In an advantageous embodiment, the controller is adapted to control the actuator corresponding to each individual indicator element so that the individual indicator element may be positioned in at least 15, preferably at least 20, more preferred at least 30, and most preferred at least 35 different rotational positions about the axis of rotation of the cylindrical element, and the computer controlled database system is adapted to store each of such distinctive rotational positions of the individual indicator element as belonging to a corresponding distinctive individual identification pattern to be formed in a casting.

In an embodiment, the imaging device is included in a handheld device. Thereby, the detection of the identification pattern in a casting during inspection may be performed without handling, i.e. moving, the casting on the conveyor, and the inspection may therefore be facilitated especially in the case of heavy castings. The handheld device may include a light source adapted to illuminate the identification pattern in the casting during provision of an image of the identification pattern.

In an embodiment, the imaging device is included in a stationary device mounted at the inspection station. This may be advantageous, in particular in the case of relatively smaller castings to be scanned by the operator. Thereby, the operator does not need to carry a handheld device. The stationary device may include a light source adapted to illuminate the identification pattern in the casting during provision of an image of the identification pattern.

In an embodiment, the handheld device or the stationary device includes an interface for input of quality data for a finished casting to the computer controlled database system, the quality data relates to a casting of which the imaging device provides a digital image of the individual identification pattern formed in the casting, and the quality data for the casting indicates at least whether the casting is acceptable or not and possibly indicates a type of deficiency of the finished casting. Thereby, the inspection and quality assessment of the finished castings may be facilitated in that a quality assessment of each casting may be performed at the same time as the casting is so to say scanned, that is, a digital image of the individual identification pattern formed in the casting is provided by the imaging device. For instance, an operator may press one of several quality related icons on a pressure sensitive screen of the handheld device or the stationary device before, after, or simultaneously with that the imaging device provides the digital image of the individual identification pattern. If only two icons are used, they may for instance simply be denoted "ok" or "not ok". Said quality related icons may among many others relate to porosities, sand inclusions and hit marks. For instance, the icon may be chosen and pressed, where after the imaging device of the handheld device or the stationary device is looking for an individual identification pattern until it appears before a lens of the imaging device, and then the digital image of the individual identification pattern is provided and processed by the computer system. It is further possible that the inspection and quality assessment of the finished castings may be performed automatically by means of automatic image analysis. In this case, all the finished castings may be scanned or a digital image of each of the finished castings may be provided by means of a camera, and resulting 2D or 3D digital images may be analysed by means of a computer system running a computer program developed by means of machine learning or employing artificial intelligence in the form of machine learning in any suitable way. The castings may thereby automatically be registered in different categories as for instance: accepted, porosities, sand inclusions and hit marks. The resulting quality data for the finished castings may then be transferred to the computer controlled database system.

In an embodiment, the handheld device or the stationary device includes an interface for reading out an estimate of the accuracy of the performed detection of the individual identification pattern, preferably a percentage. Thereby, the operator may easily decide whether the performed detection should be repeated in order to obtain a better result.

In an embodiment, the finishing apparatus is adapted to clean castings by means of blasting, such as shot blasting. Thereby, the surface of castings may be improved.

In an embodiment, the pattern plate is provided with one or more sand mould identification devices connected to the controller by means of a single connector including a first connector part arranged on the pattern plate and a second connector part arranged on the sand moulding machine, each connector part includes a number of electrical contact elements, and the electrical contact elements of the second connector part are adapted to flexibly engage and slide on a top side of the respective electrical contact elements of the first connector part during a mounting operation of the pattern plate on the sand moulding machine. Thereby, a stable, cabled connection to the controller may be provided without risk that sand and dust build up on the contact surfaces of the contact elements of the first and second connector part. Because the electrical contact elements of the second connector part are adapted to flexibly engage and slide on a top side of the respective electrical contact elements of the first connector part during a mounting operation, any sand or dust left on the contact surfaces will be removed by the sliding action at each mounting operation.

In an embodiment, the computer controlled database system is adapted to store a data set corresponding to each individual identification pattern, each said data set including production variables measured and/or set during production related to said individual identification pattern. Thereby, if a finished casting is determined to be defective, the type of deficiency may be added to the data set and the production variables measured and/or set during production related to that casting and/or to castings having the same type of deficiency may subsequently be retrieved from the computer controlled database system and the cause of the specific defect may be assessed. In this way, optimal production variables may be determined for the continued production and the number of deficient castings may be reduced effectively.

In an advantageous embodiment, each said data set includes at least the following data: a casting identification (ID) corresponding to the detected individual identification pattern, quality data for the finished casting indicating at least whether the casting is acceptable or not, sand test data, metallurgical data, and melt pouring data.

In an advantageous embodiment, each said data set includes at least the following data: a casting identification (ID) corresponding to the detected individual identification pattern, quality data for the finished casting indicating at least whether the casting is acceptable or not, sand test data in the form of compactability and green compression strength, metallurgical data in the form of a chemical analysis of metal in furnace and/or ladle, melt pouring device data in the form of pouring temperature, and sand moulding machine data in the form of mould compressibility.

The present invention further relates to a method of operating a foundry production line, whereby sand moulds are produced in a sand moulding machine, melt is poured into the sand moulds in a melt pouring device, and sand moulds are broken apart and castings are taken out in a shakeout machine, the sand moulding machine including at least one moulding chamber in which at least one pattern plate forms a pattern in a sand mould part during compaction of the sand mould part in the moulding chamber, at least one sand mould identification device including a plurality of individually adjustable indicator elements providing a corresponding identification pattern in each sand mould before melt is poured into the sand mould, each individual indicator element being formed at an end of a rotationally arranged cylindrical element, the rotational position of each individual indicator element about an axis of rotation of the corresponding cylindrical element being adjusted by means of an actuator being controlled by a controller so that each sand mould formed by two sand mould parts is provided with at least one individual identification pattern which subsequently forms a corresponding individual identification pattern in a resulting casting, whereby an automatic image detection system detects the resulting individual identification patterns in at least some of the castings, and whereby a computer controlled database system stores data relating to a number of production variables being measured and/or set during production and data relating to the quality of the produced castings.

The method is characterised in that each individually adjustable indicator element is formed with rounded edges and indicates a direction along a diameter of the corresponding cylindrical element on which it is arranged, in that castings are cleaned in a finishing apparatus, in that castings are inspected in an inspection station after being cleaned in the finishing apparatus, in that an imaging device of the automatic image detection system is arranged in the inspection station and provides a digital image of the individual identification pattern formed in at least some of the cleaned castings, and in that a computer system of the automatic image detection system runs a computer program developed by means of machine learning and thereby analyses the provided digital images and detects the individual identification patterns of the respective cleaned castings. Thereby, the above-mentioned features may be obtained.

In an embodiment, the computer system validates the correctness of the detected individual identification pattern of the cleaned casting, preferably by providing an estimate of the accuracy of the performed detection of the individual identification pattern. Thereby, the above-mentioned features may be obtained.

In an embodiment, the at least one sand mould identification device impresses an identification pattern in a sand mould part during its compaction. Thereby, the above-mentioned features may be obtained.

In an embodiment, the digital image of the individual identification pattern formed in a cleaned casting is provided by means of a handheld device held by an operator or by means of a stationary device operated by an operator. Thereby, the above-mentioned features may be obtained.

In an embodiment, before, after, or simultaneously with the imaging device providing the digital image of the individual identification pattern of a finished casting, the operator inputs quality data for the finished casting to the computer controlled database system by means of an interface provided on the handheld device or on the stationary device, and the quality data for the casting indicates at least whether the casting is acceptable or not and possibly indicates a type of deficiency of the finished casting. Thereby, the above-mentioned features may be obtained.

In an embodiment, the operator receives an estimate of the accuracy of the performed detection of the individual identification pattern, preferably a percentage, by means of an interface provided on the handheld device or on the stationary device. Thereby, the above-mentioned features may be obtained.

In an embodiment, the computer controlled database system stores a data set corresponding to each individual identification pattern, and each said data set includes production variables being measured and/or set during production and being related to said individual identification pattern. Thereby, the above-mentioned features may be obtained.

The invention will now be explained in more detail below by means of examples of embodiments with reference to the very schematic drawing, in which FIG. 1 is a perspective view of a foundry production line according to the invention;

Figure 1:
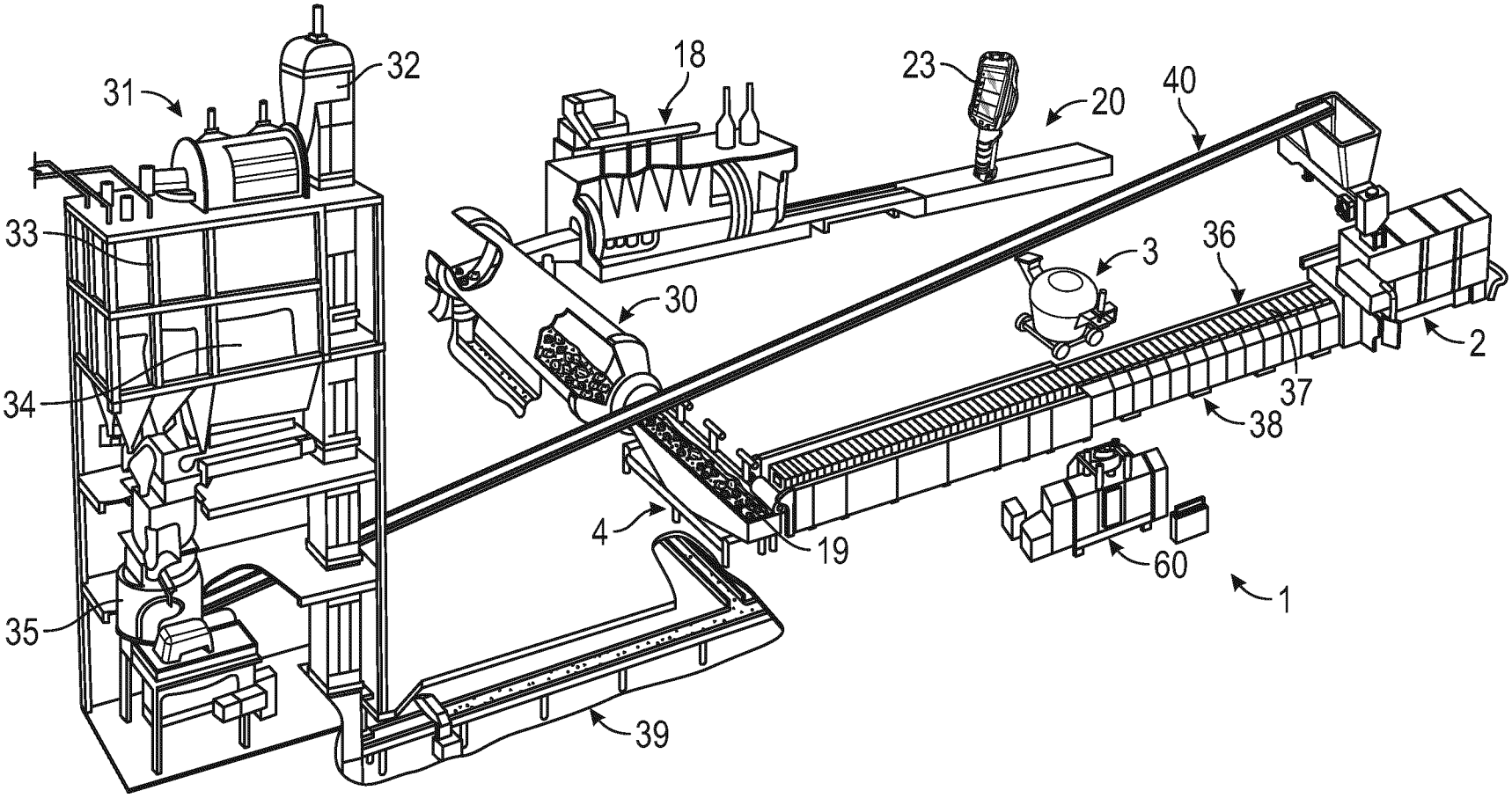

FIG. 1 illustrates a foundry production line 1 according to the present invention. The foundry production line 1 includes, seen in a transport direction of the castings 19, a sand moulding machine 2, a melt pouring device 3, a shakeout machine 4 for breaking apart sand moulds 36 and taking out castings 19, a finishing apparatus 18 adapted to clean castings 19 and an inspection station 20 for inspection of castings 19. Furthermore, seen to the left in the figure, the foundry production line 1 includes a green sand storage and preparation unit 31 including a sand elevator 32, a screen 33, a silo 34 and a sand mixer 35. Sand from the shakeout machine 4 is reused and transported to the green sand storage and preparation unit 31 by means of a return sand conveyor 39. Prepared sand is transported from the green sand storage and preparation unit 31 to the sand moulding machine 2 by means of a sand conveyor 40.

Figure 4:
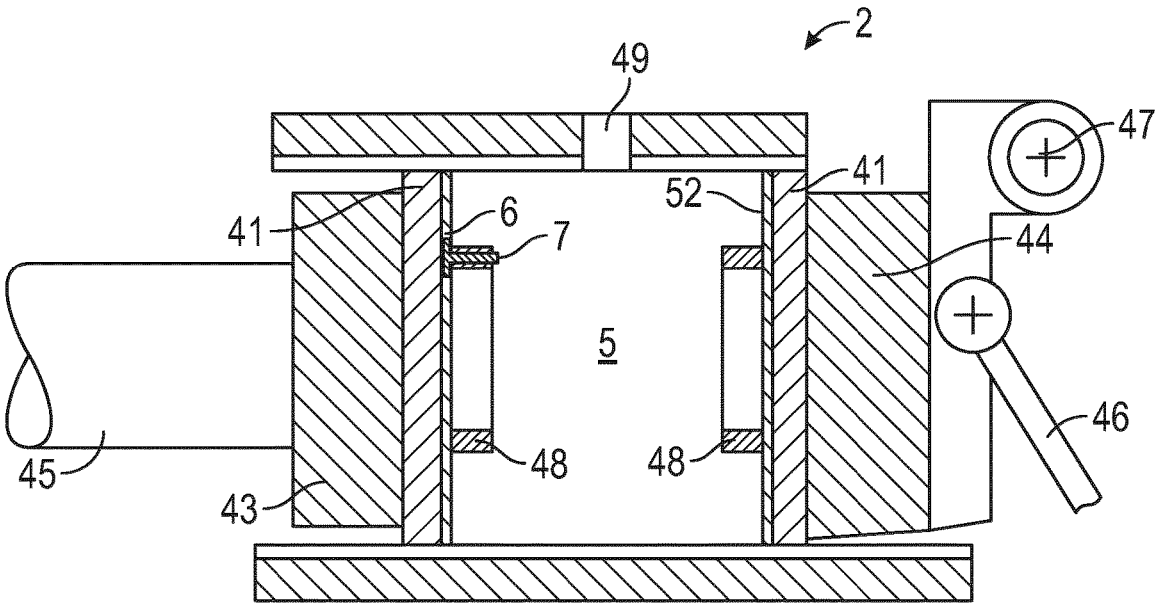
FIG. 4 is a longitudinal cross-section through a vertical sand moulding machine of the foundry production line of FIG. 1.
Figure 6:
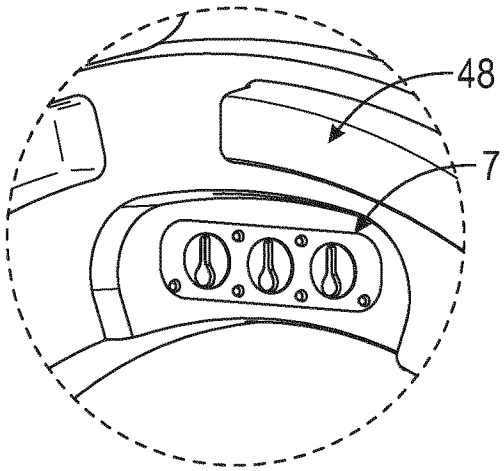
FIG. 6 illustrates a detail of FIG. 5 on a larger scale.
Figure 5:
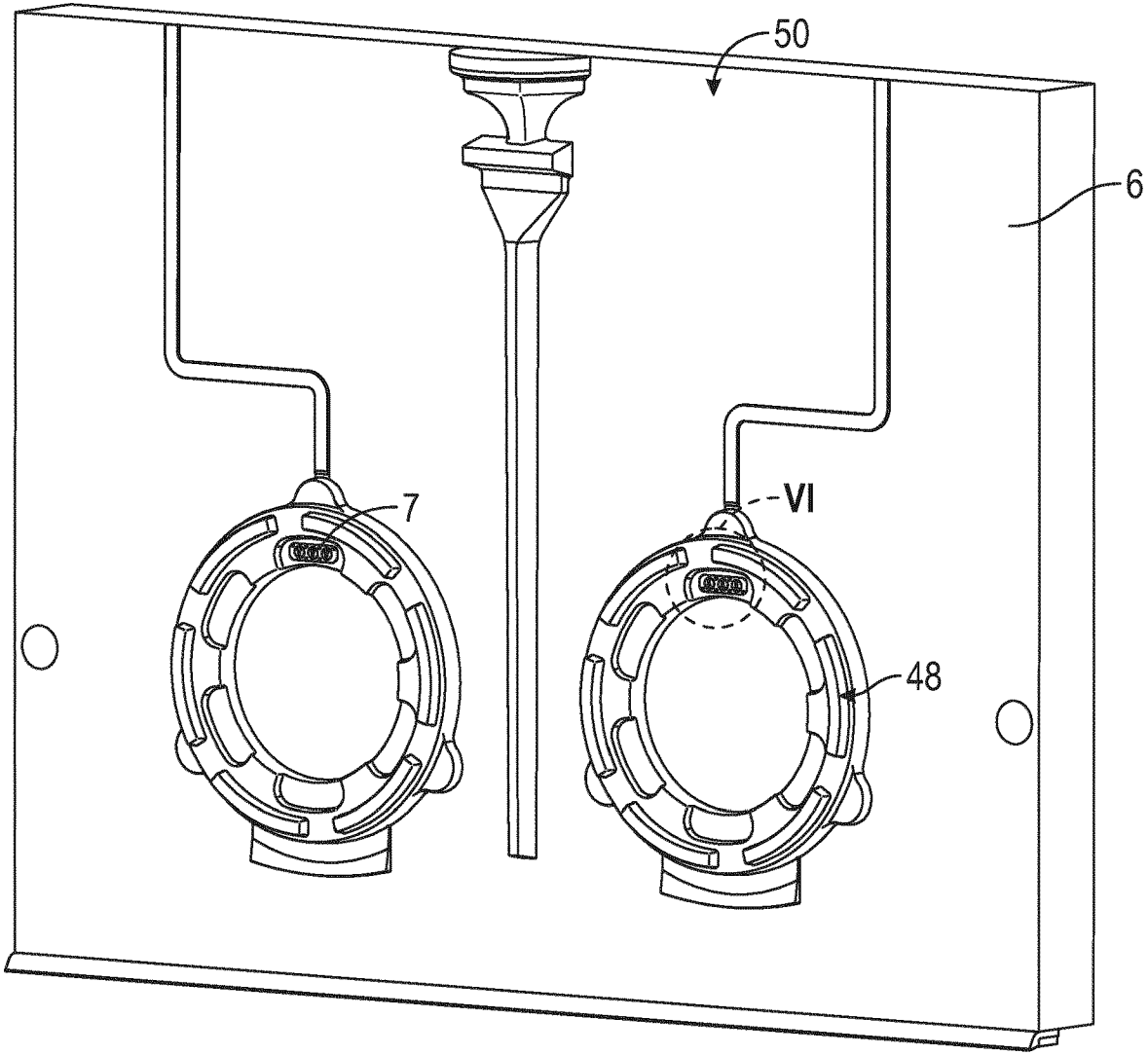
FIG. 5 is a perspective view of a front side of a pattern plate for the vertical sand moulding machine of the foundry production line of FIG. 1.
Figure 8:
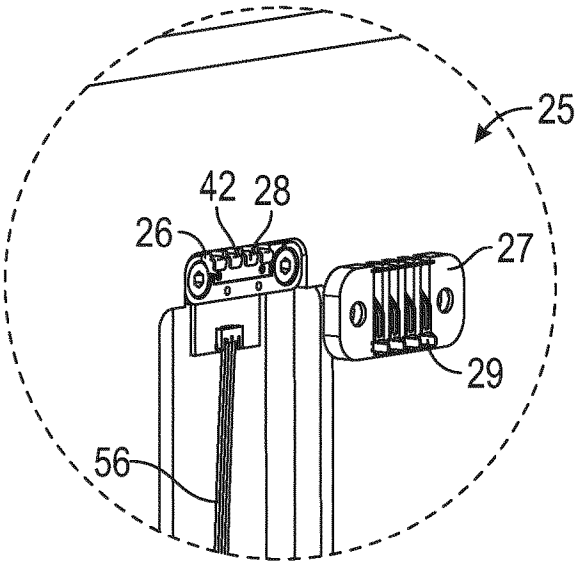
FIG. 8 illustrates a first detail of FIG. 7 on a larger scale.
Figure 9:
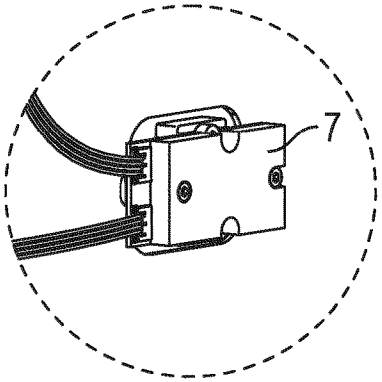
FIG. 9 illustrates a second detail of FIG. 7 on a larger scale.
Figure 7:
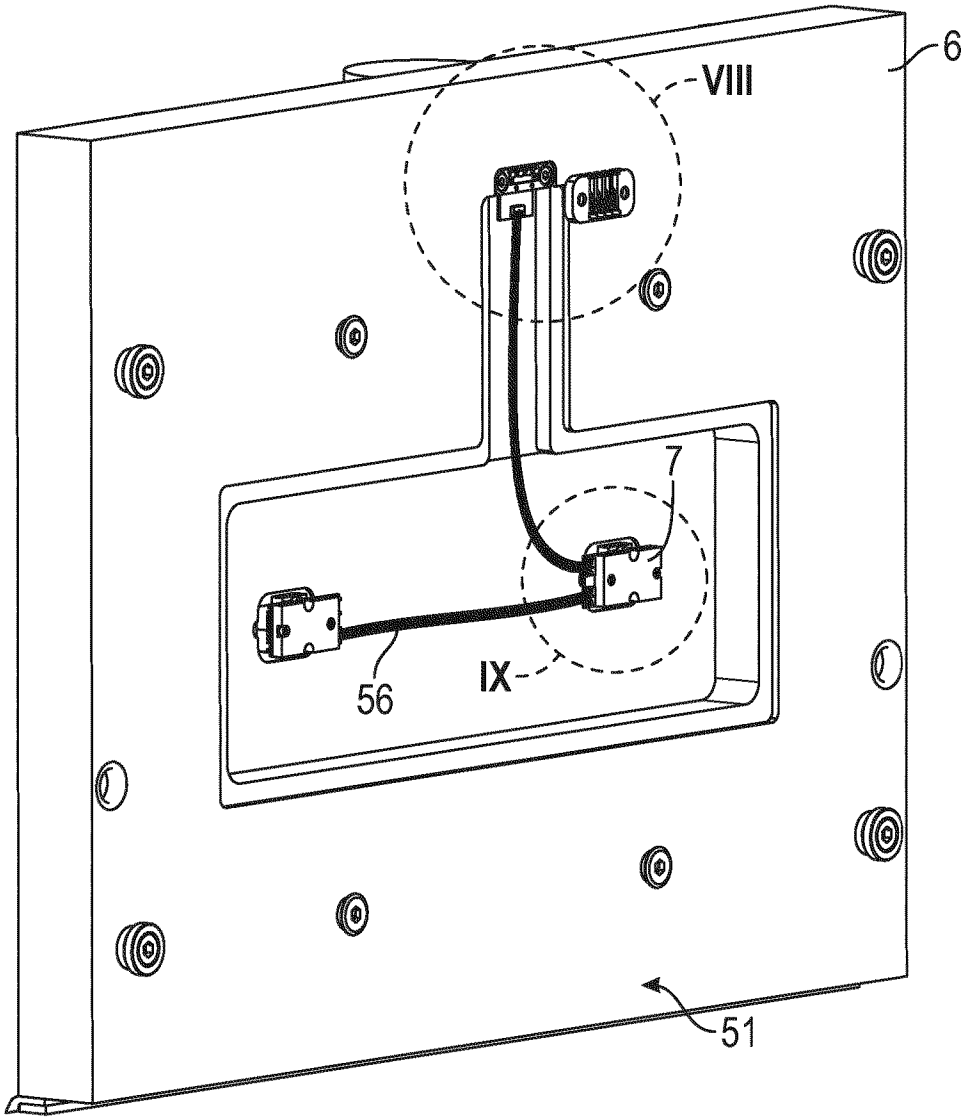
FIG. 7 is a perspective view of a back side of the pattern plate of FIG. 5.
Figure 11:
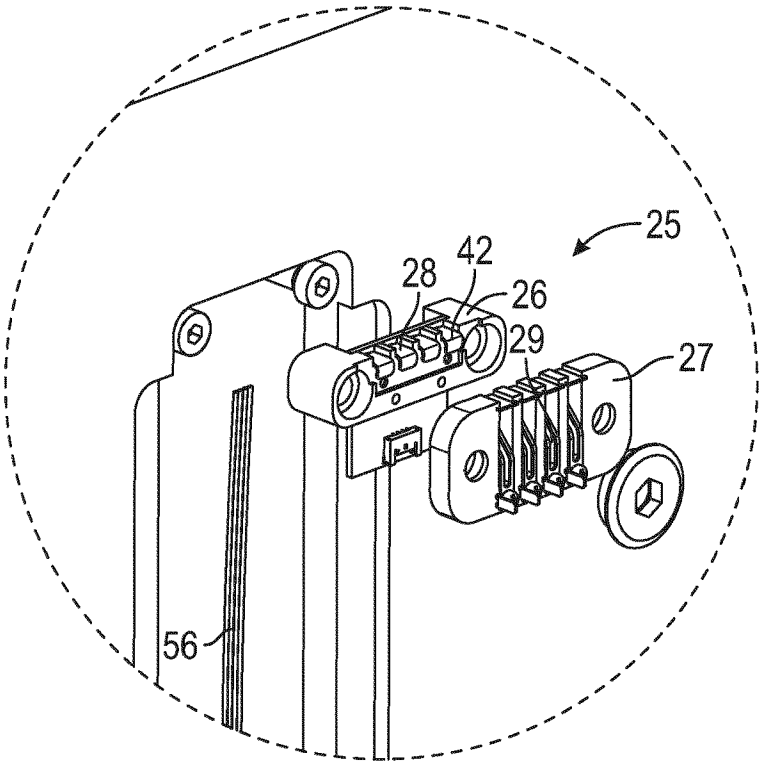
FIG. 11 illustrates a detail of FIG. 10 on a larger scale.

As illustrated in FIG. 4, the sand moulding machine 2 includes a moulding chamber 5 in which a first pattern plate 6 arranged on a pressing plate 43 and a second pattern plate 52 arranged on a swing plate 44 are adapted to form respective patterns in either side of a sand mould part 37 during compaction of the sand mould part in the moulding chamber 5. As seen, each of the first pattern plate 6 and the second pattern plate 52 is provided with a pattern 48. The illustrated sand moulding machine 2 is a vertical flaskless sand moulding machine of the DISAMATIC (registered trade mark) type. The working principle of this type of sand moulding machine is well-known. The moulding chamber 5 is filled with sand through a sand filling opening 49 in a top wall of the moulding chamber, and the sand is compacted by displacement of the first and/or second pattern plates 6, 52 in a direction against each other. Subsequently, the swing plate 44 is displaced and pivoted to an open position in which the sand mould part may leave the moulding chamber in a direction which is directed to the right in FIG. 4. It is noted that in FIG. 1, the sand moulding machine 2 is arranged so that the sand mould parts may leave the moulding chamber in a direction which is directed obliquely to the left in the figure. The sand mould part is pressed out of the moulding chamber by displacement of the pressing plate 43 until the sand mould part abuts the previously produced sand mould part on a sand mould conveyor 38 and a sand mould is formed between those two sand mould parts 37. Thereby, a string of sand moulds 36 is produced as seen in FIG. 1.

Figure 2:
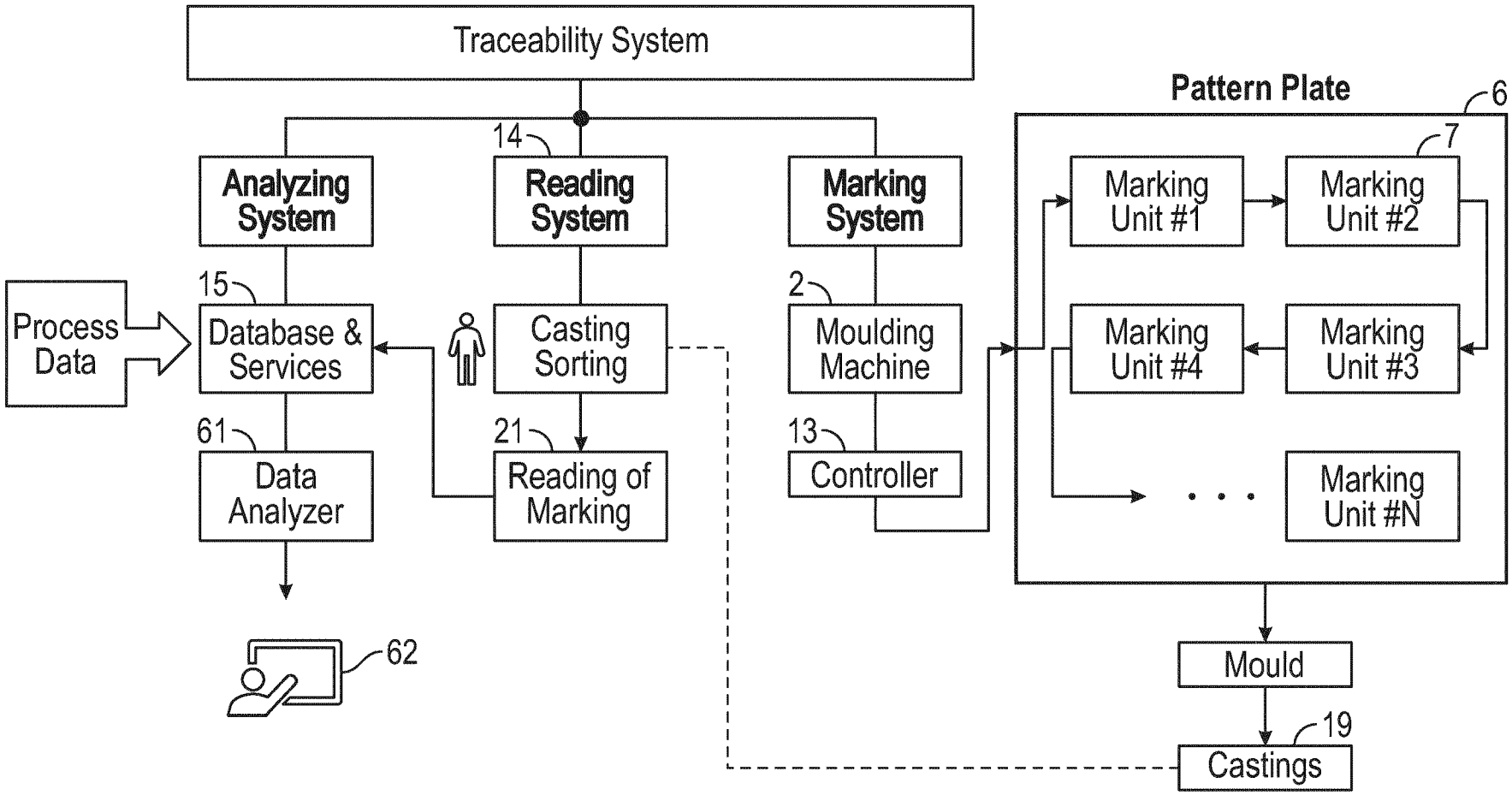
FIG. 2 is a diagram illustrating a traceability system of the foundry production line of FIG. 1.

The first pattern plate 6 of the sand moulding machine 2 illustrated in FIG. 4 is provided with a single sand mould identification device 7 illustrated in more detail in FIGS. 13 to 17. The sand mould identification device 7 includes three individually adjustable indicator elements 8, 9, 10 adapted to impress an identification pattern in a sand mould part 37 during its compaction. Each individual indicator element 8, 9, 10 extends in a diametrical direction at an end 12 of a respective cylindrical element 11 arranged rotationally in a housing 53 of the sand mould identification device 7. The rotational position of each individual indicator element 8, 9, 10 about an axis of rotation of the corresponding cylindrical element 11 is adjustable by means of a not shown actuator being controlled by a controller 13 as illustrated in FIG. 2. The controller 13 is adapted to provide each sand mould 36 formed by two sand mould parts 37 with at least one individual identification pattern arranged to form an individual identification pattern in each resulting casting 19 when the sand mould 36 has been filled with molten metal in the melt pouring device 3. As seen, each sand mould produced by the sand moulding machine 2 illustrated in FIG. 4 results in one casting provided with a corresponding identification pattern. However, the pattern plate 6 illustrated in FIGS. 5 to 11 is adapted to form two castings, and therefore, the pattern plate 6 is provided with two sand mould identification devices 7 arranged at the respective patterns 48 of the pattern plate so that each casting may be provided with its own identification pattern. In other embodiments, a pattern plate may be adapted to form three or more castings, and the pattern plate may then be provided with a corresponding number of sand mould identification devices 7 arranged at the respective patterns 48.

When a pattern plate is provided with more than one pattern 48 and thereby is adapted to form two or more castings, each pattern 48 may be provided with a so-called cavity ID which may not be detectable by the automatic image detection system. In order to provide more combinations than possible by one sand mould identification device, each sand mould identification device of the pattern plate may be controlled by the controller 13 to impress identical patterns when a sand form part is produced. Thereby, for instance, if a pattern plate is provided with four patterns 48, each sand mould may produce four castings all having identical identification patterns. However, when the castings are inspected at the inspection station, an operator may read the cavity ID of castings which are scanned and register the cavity ID together with the quality data in the database system.

Furthermore, a pattern 48 of a pattern plate may be provided with more than one sand mould identification device 7 in order to obtain more possible combinations of individually adjustable indicator elements. Thereby, each resulting casting 19 may be provided with more than one individual identification pattern. This may be an advantage, if the size and configuration of the pattern 48 does not allow the incorporation of one single sand mould identification device 7 having the required number of individual indicator elements. In this case, for instance, a first sand mould identification device 7 having two or three individual indicator elements 8, 9, 10 may be incorporated at a first position of the pattern 48 and a second sand mould identification device 7 having for instance one, two or three individual indicator elements 8, 9, 10 may be incorporated at a second position of the pattern 48. Likewise, each resulting casting 19 may be provided with more than one individual identification pattern by incorporating a first sand mould identification device 7 having two or three individual indicator elements 8, 9, 10 in a pattern 48 of a first pattern plate 6 and a second sand mould identification device 7 having for instance one, two or three individual indicator elements 8, 9, 10 in a corresponding pattern 48 of a second pattern plate 52.

Although the illustrated sand moulding machine 2 is a vertical flaskless sand moulding machine, the present invention is equally applicable to other types of sand moulding machines, such as a sand moulding machine of the match plate type. In a sand moulding machine of the match plate type, the sand moulding machine includes two moulding chambers separated by means of a match plate. On either side of the match plate, a pattern plate is formed and is adapted to form a corresponding pattern in the corresponding sand mould part during compaction of the sand mould part in the respective moulding chamber. In a foundry production line 1 according to the present invention including a sand moulding machine of the match plate type, at least one of the pattern plates formed on the match plate is provided with at least one sand mould identification device 7 as illustrated in FIGS. 13 to 17. Thereby, each sand mould formed by two sand mould parts may be provided with at least one individual identification pattern, according to the number of castings formed in the sand mould.

As a further example, the present invention is equally applicable to a horizontal flask line in which cope and drag are combined to form a flask. Each of the cope and drag is provided with a pattern plate. In a foundry production line according to the present invention of the horizontal flask line type, at least one of the two pattern plates is provided with at least one sand mould identification device 7 as illustrated in FIGS. 13 to 17. Thereby, each sand mould formed in a flask composed by cope and drag may be provided with at least one individual identification pattern, according to the number of castings formed in the sand mould.

The foundry production line 1 further includes an automatic image detection system 14 adapted to detect the resulting individual identification patterns in the castings and a computer controlled database system 15 adapted to store data relating to a number of production variables measured and/or set during production and data relating to the quality of the produced castings.

According to the present invention, each individually adjustable indicator element 8, 9, 10 is formed with rounded edges 16 and is formed to indicate a direction 17 along a diameter of the corresponding cylindrical element 11 on which it is arranged. In the embodiment illustrated in FIGS. 16 and 17, it is seen that, preferably, the individually adjustable indicator element 8 is formed with all its edges being rounded so that no sharp edges are present. Furthermore, it is seen that the individually adjustable indicator element 8 is formed to indicate the direction 17 along the diameter of the corresponding cylindrical element 11 in that the individually adjustable indicator element 8 forms a relatively broad, partly circular part 54 at a first end of the diameter of the cylindrical element 11 and a relatively narrow, elongated part 55 at a second end of the diameter of the cylindrical element 11. The illustrated form of the individually adjustable indicator element 8 may further be said to be more or less drop-like. In other embodiments, the individually adjustable indicator element 8 may be formed to indicate the direction 17 along the diameter of the corresponding cylindrical element 11 in other ways, for instance, the individually adjustable indicator element 8 may taper regularly or irregularly from the first end of said diameter to the second end of said diameter. In other embodiments, the individually adjustable indicator element 8 may have the form of a watch hand, preferably including a kind of arrow-like element. It is preferred that each individually adjustable indicator element 8, 9, 10 is formed as a protrusion from the end 12 of the respective cylindrical element 11 arranged rotationally in the housing 53 of the sand mould identification device 7, as seen in the embodiment illustrated in FIGS. 16 and 17. However, in an alternative embodiment, each or some of the individually adjustable indicator elements 8, 9, 10 may be formed as a depression in the end 12 of the respective cylindrical element 11. It is also possible that a first part of an individually adjustable indicator element 8, 9, 10 is formed as a protrusion and a second part of said individually adjustable indicator element is formed as a depression. For instance, the relatively broad, partly circular part 54 at the first end of the diameter of the cylindrical element 11 may be formed as a protrusion and the relatively narrow, elongated part 55 at the second end of the diameter of the cylindrical element 11 may be formed as a depression.

Figure 18:
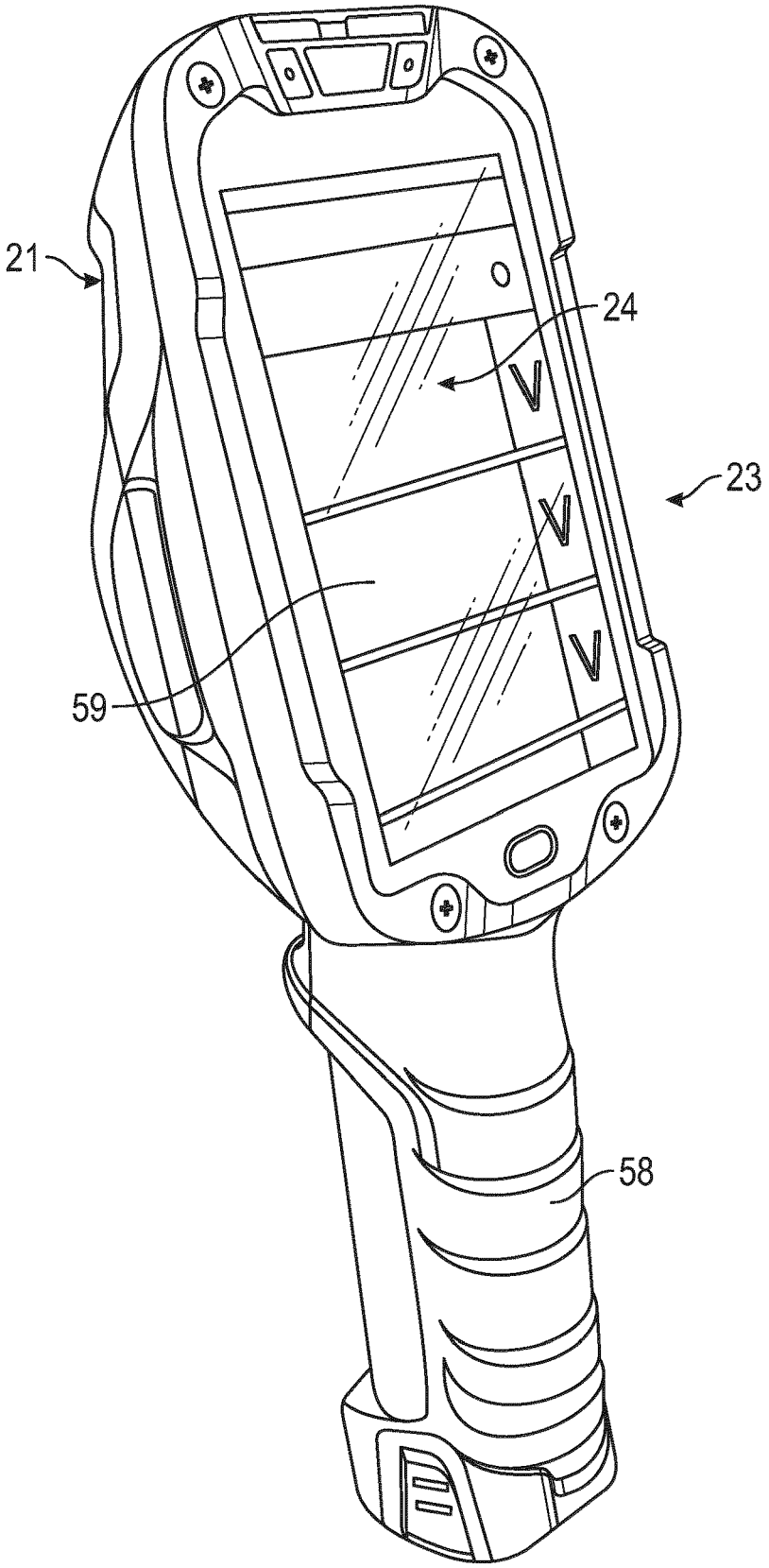
FIG. 18 is a perspective view of a handheld device of the foundry production line of FIG. 1, wherein the handheld device includes an imaging device.

According to the present invention, the automatic image detection system 14 includes an imaging device 21 arranged at the inspection station 20, and the imaging device 21 is adapted to provide a digital image of an individual identification pattern formed in a cleaned casting 19. Preferably, the imaging device 21 is adapted to provide a 2D digital image of the individual identification pattern, but an imaging device producing a 3D digital image may also be used. The imaging device 21 may for instance be a commercially available digital camera corresponding to the type provided in many cell phones. In the illustrated embodiment, as seen in FIGS. 1 and 18, the imaging device 21 is included in a handheld device 23 adapted to be used by an operator at the inspection station 20. This may be advantageous, because the castings 19 are normally arranged erratically on the conveyor when leaving the finishing apparatus 18. As the castings may be heavy, it is of advantage that the operator generally only needs to move a few of the castings in order to scan the castings to provide a digital image of an individual identification pattern formed in the casting.

The handheld device may include a light source adapted to illuminate the identification pattern in the casting during provision of an image of the identification pattern. Additionally or alternatively, the inspection station 20 may include one or more light sources adapted to illuminate the identification pattern in the casting during provision of an image of the identification pattern.

However, the imaging device 21 may also be included in a stationary device mounted at the inspection station 20. This may be advantageous, in particular in the case of relatively smaller castings to be scanned by the operator. Thereby, the operator does not need to carry a handheld device. The stationary device may include a light source adapted to illuminate the identification pattern in the casting during provision of an image of the identification pattern.

Advantageously, the computer system may be adapted to validate the correctness of the detected individual identification patterns of the cleaned castings, preferably by providing an estimate of the accuracy of the performed detection of the individual identification pattern. Thereby, if the likelihood of a correctly detected individual identification pattern is low, the detection may be repeated in order to receive a better estimate of the accuracy. In this way, the quality of the data stored in the database may be optimised and the result of an analysis performed on the basis of the data may be better.

The handheld device 23 or the stationary device may include an interface for reading out an estimate of the accuracy of the performed detection of the individual identification pattern, preferably a percentage. Thereby, the operator may easily decide whether the performed detection should be repeated in order to obtain a better result.

In the embodiment illustrated in FIG. 18, the handheld device 23 includes an interface 24 for input of quality data for a finished casting 19 to the computer controlled database system 15. The quality data relates to a casting 19 of which the imaging device 21 provides a 2D image of the individual identification pattern formed in the casting 19, and the quality data for the casting 19 indicates at least whether the casting is acceptable or not and possibly indicates a type of deficiency of the finished casting. Thereby, the inspection and quality assessment of the finished castings 19 may be facilitated in that a quality assessment of each casting may be performed at the same time as the casting is so to say scanned, that is, a 2D image of the individual identification pattern formed in the casting is provided by the imaging device 21. For instance, an operator may press one of several quality related icons on a pressure sensitive screen 59 of the handheld device 23 before, after, or simultaneously with that the imaging device 21 provides the 2D image of the individual identification pattern. For instance, the icon may be chosen and pressed, where after the imaging device of the handheld device 23 is looking for an individual identification pattern until it appears before a lens of the imaging device, and then the 2D image of the individual identification pattern is provided and processed by the computer system. Two icons may for instance simply be denoted "ok" or "not ok". Likewise, different icons may indicate different causes of deficiency (scrap causes), such as porosities, sand inclusions, hit marks, defective surfaces, etc. The described quality inspection and sorting of castings 19 performed at the inspection station 20 is illustrated in the diagram of FIG. 2 in the box "Casting Sorting".

According to the present invention, the automatic image detection system 14 includes a computer system adapted to run a computer program developed by means of machine learning to analyse the 2D digital image and thereby detect the individual identification pattern of the cleaned casting 19. Preferably, the finishing apparatus 18 is adapted to clean castings 19 by means of blasting, such as shot blasting. The prior art identification patterns and image detection systems have not been able to detect individual identification patterns of cleaned castings, and in particular not of castings 19 cleaned by means of blasting, such as shot blasting. However, according to the present invention, by providing a 2D image of an individual identification pattern formed by individually adjustable indicator elements 8, 9, 10 having rounded edges 16 and indicating a diametrical direction 17, and detecting the individual identification pattern of the finished, cleaned casting by running a computer program developed by means of machine learning to analyse the 2D image, it is possible to achieve drastically improved traceability of the produced castings 19 for retrieval of related production and quality data without slowing down production or imparting the final castings negatively.

Figure 13:
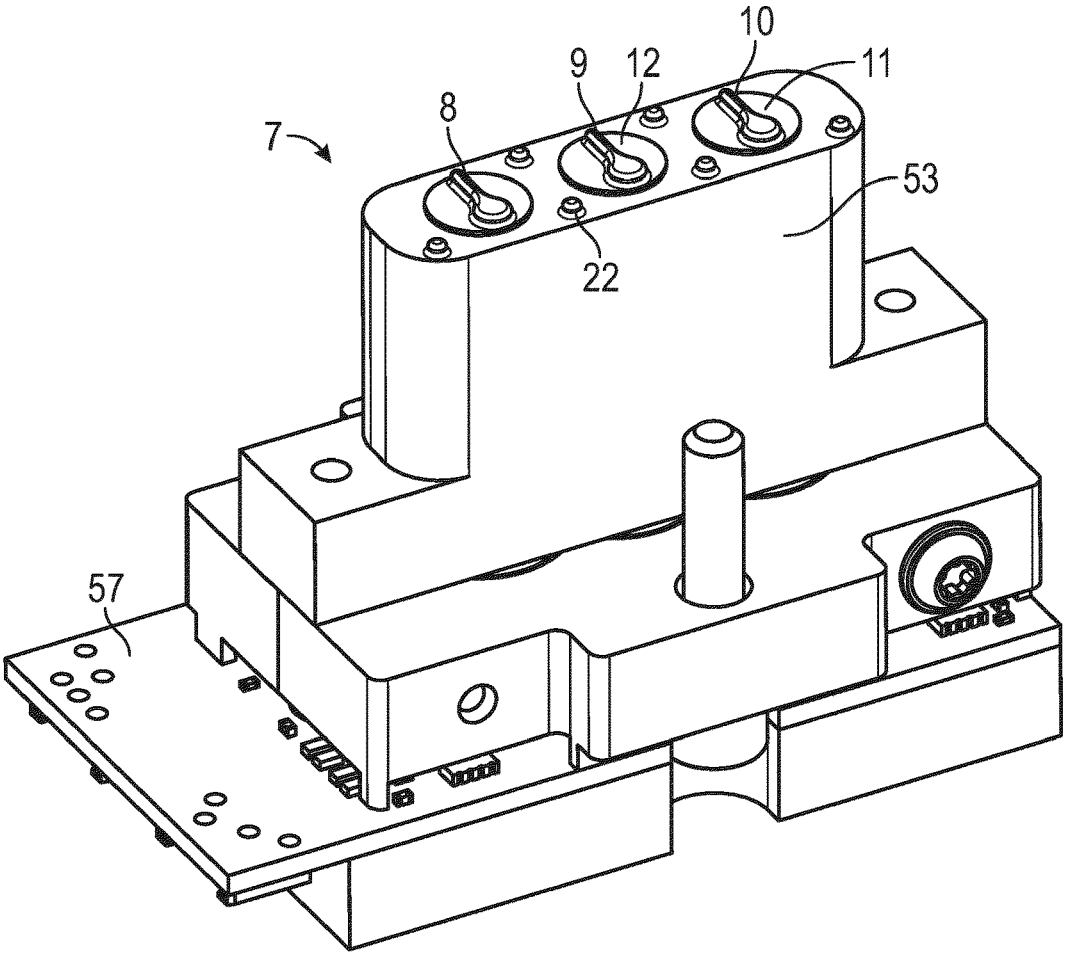
FIG. 13 is a perspective view seen obliquely from a front side of a sand mould identification device of the vertical sand moulding machine of the foundry production line of FIG. 1.
Figure 14:
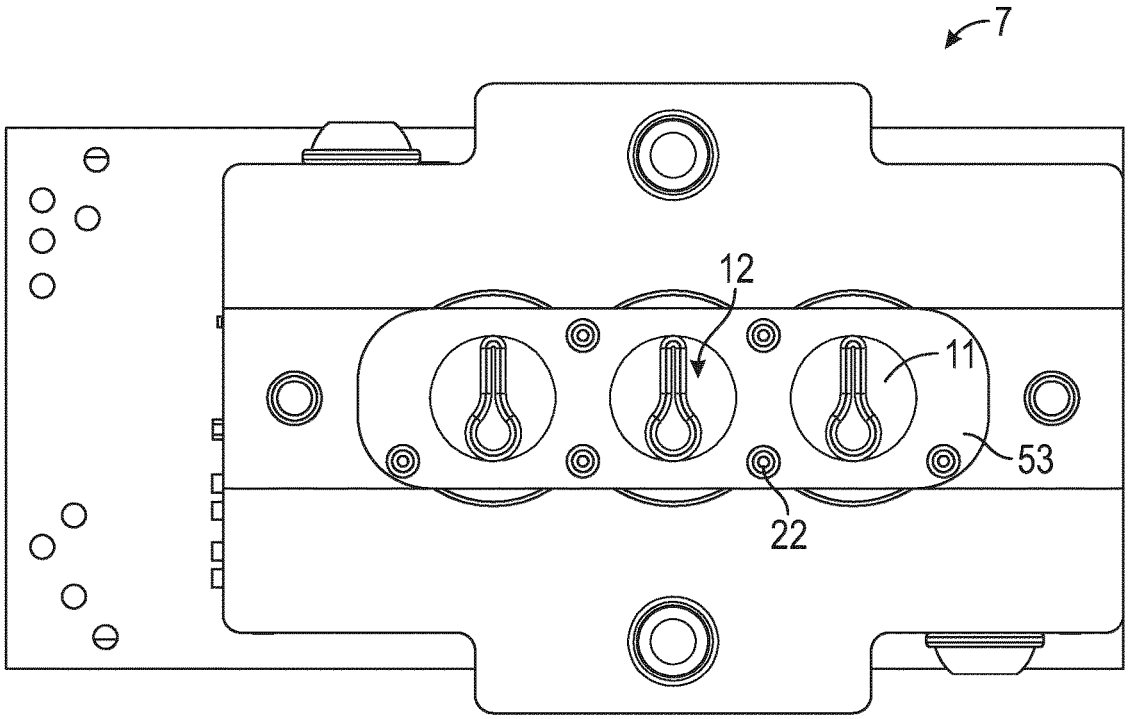
FIG. 14 is a front view of the sand mould identification device of FIG. 13.
Figure 15:
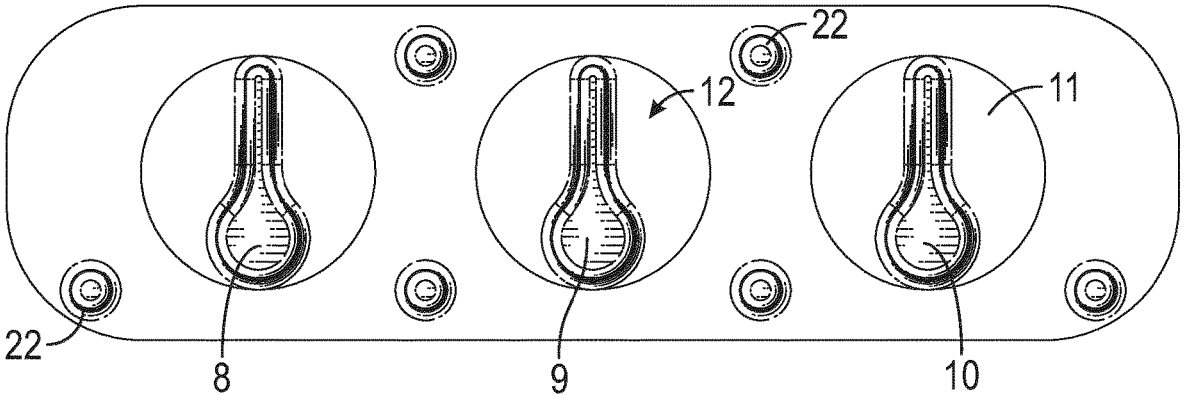
FIG. 15 illustrates part of the sand mould identification device of FIG. 14 on a larger scale.
Figure 16:
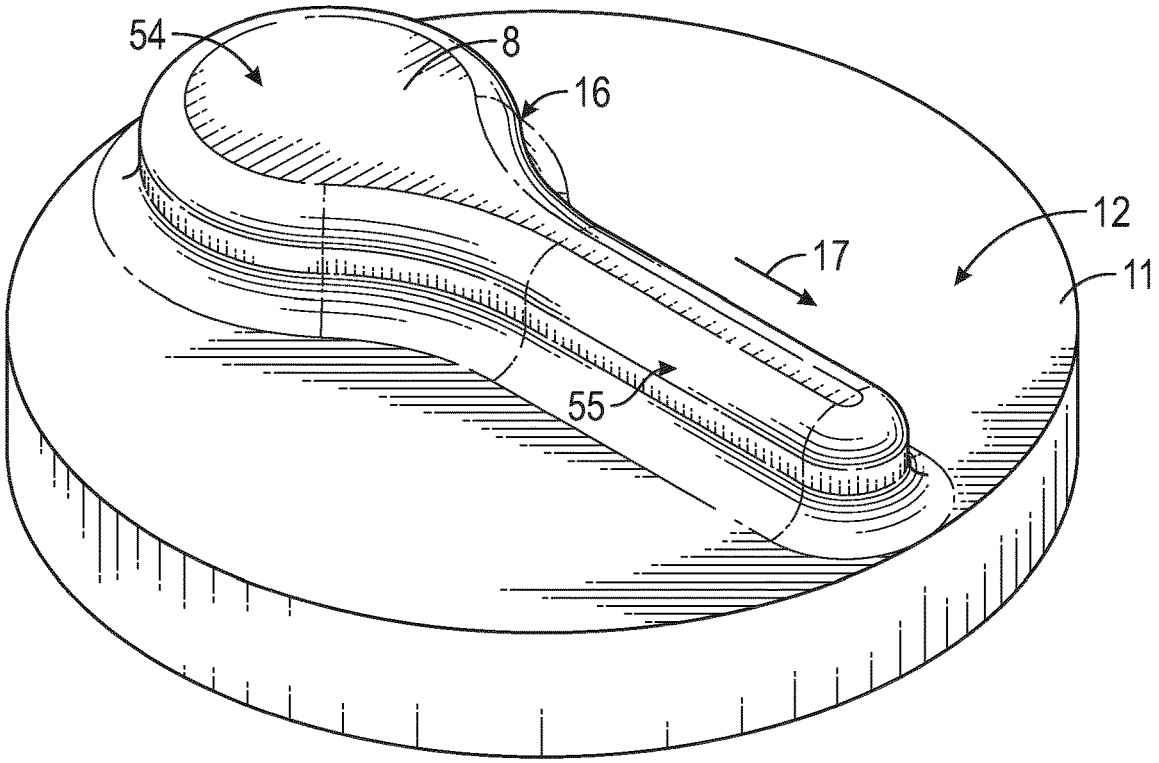
FIG. 16 is a perspective view seen obliquely from a first angle from a front side of an individual indicator element arranged at an end of a rotational cylindrical element of the sand mould identification device of FIG. 13.
Figure 17:
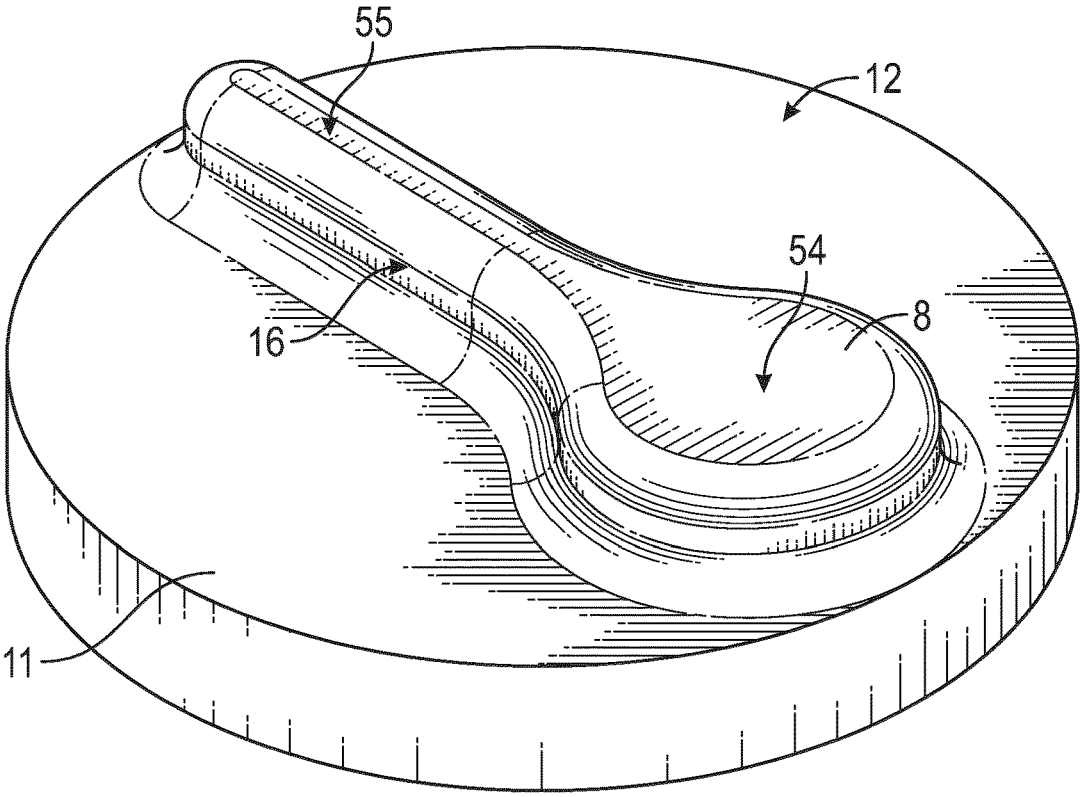
FIG. 17 is a perspective view seen obliquely from a second angle from the front side of the individual indicator element of FIG. 16.

In the embodiment illustrated in FIGS. 13 to 15, the sand mould identification device 7 includes six stationary alignment elements 22 adapted to impress an alignment pattern in a sand mould part 37 during its compaction. The automatic image detection system 14 is adapted to, before detection of an individual identification pattern in a casting 19, align the 2D digital image with a reference image of the alignment pattern. As further seen, the three rotationally arranged cylindrical elements 11 are arranged side by side along a line, and the six stationary alignment elements 22 are arranged asymmetrically about said line in that four of the stationary alignment elements 22 are arranged along a line below the three rotationally arranged cylindrical elements 11 and two of the stationary alignment elements 22 are arranged along a line above the three rotationally arranged cylindrical elements 11. Of course, many other asymmetrical arrangements of a suitable number of stationary alignment elements 22 are possible. The asymmetrical arrangement of the stationary alignment elements 22 may indicate a reading orientation for the impressions provided by the individually adjustable indicator elements 8, 9, 10 and the possible number of different combinations that may be achieved by the individually adjustable indicator elements may thereby be increased.

Although in the illustrated embodiment, the three rotationally arranged cylindrical elements 11 are arranged side by side along a line, many other arrangements of the rotationally arranged cylindrical elements 11 are possible. Furthermore, any other suitable number of rotationally arranged cylindrical elements 11 may be arranged in a sand mould identification device 7. For instance, three rotationally arranged cylindrical elements 11 may be arranged in a triangular arrangement, four rotationally arranged cylindrical elements 11 may be arranged in a rectangular or square arrangement or five rotationally arranged cylindrical elements 11 may be arranged in a pentagonal or circular configuration. Likewise, a number of sand mould identification devices 7 may be combined in one pattern 48 of a pattern plate 6, 52 in order to obtain a suitable number of rotationally arranged cylindrical elements 11 for one pattern 48, as already explained above.

In an embodiment, each individual indicator element 8, 9, 10 illustrated in FIGS. 13 to 17 extends at least 0.5 millimetres, preferably at least 0.7 millimetres, and most preferred at least 0.9 millimetres from the corresponding end 12 of the rotationally arranged cylindrical element 11.

In an embodiment, the controller 13 is adapted to control the actuator corresponding to each individual indicator element 8, 9, 10 so that the individual indicator element may be positioned in at least 15, preferably at least 20, more preferred at least 30, and most preferred at least 35 different rotational positions about the axis of rotation of the cylindrical element 11. Advantageously, the controller 13 may be adapted to control the actuator corresponding to each individual indicator element 8, 9, 10 so that the individual indicator element may be positioned in about 40 different rotational positions. The controller 13 may be adapted to control the actuator corresponding to each individual indicator element 8, 9, 10 so that the rotational position of the individual indicator element 8, 9, 10 about the axis of rotation of the corresponding cylindrical element 11 is adjusted in increments of less than 20 degrees, preferably of less than 15 degrees, and most preferred of less than 10 degrees. The actuator is preferably a stepper motor, preferably driven by microstepping the stepper motor, provided with a suitable transmission, such as a planetary gear. The computer controlled database system 15 is adapted to store each of such distinctive rotational positions of the individual indicator element 8, 9, 10 as belonging to a corresponding distinctive individual identification pattern to be formed in a casting 19.

As seen in the embodiment illustrated in FIGS. 7 to 12, the pattern plate 6 of the sand moulding machine 2 is provided with two sand mould identification devices 7 connected to the controller 13 by means of a single connector 25 including a first connector part 26 arranged on the pattern plate 6 and a second connector part 27 arranged on the sand moulding machine 2. As seen, depending on the number of castings to be produced in the sand mould, a corresponding number of sand mould identification devices 7 are connected one after the other in a line by means of a network cable 56 which is finally connected to the first connector part 26. Each sand mould identification device 7 includes a network card 57 as seen in FIG. 13. The second connector part 27 is connected to the controller 13 arranged in the sand moulding machine 2 as illustrated in FIG. 2. Thereby, the network card 57 of each sand mould identification device 7 may communicate with the controller 13 and be provided with power via the network cable 56 and the connector 25. Although in the illustrated embodiment, the sand moulding machine 2 includes a common controller 13 for all sand mould identification devices 7, in other embodiments, each sand mould identification device 7 may include its own controller communicating via the single connector 25 with the computer controlled database system 15 of the foundry production line 1.

Figure 10:
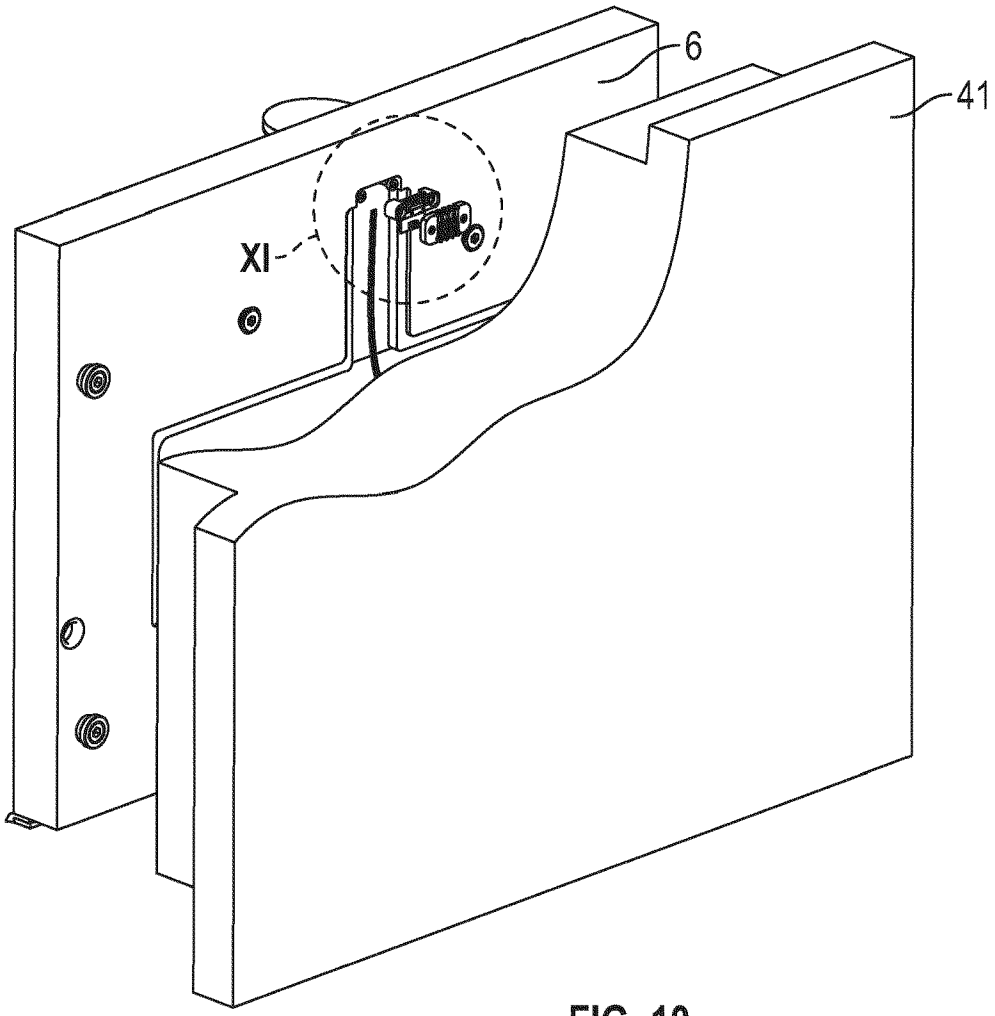
FIG. 10 is a perspective exploded view illustrating part of the back side of the pattern plate of FIG. 7 and part of a heating plate of the vertical sand moulding machine on which the pattern plate is to be mounted.
Figure 12:
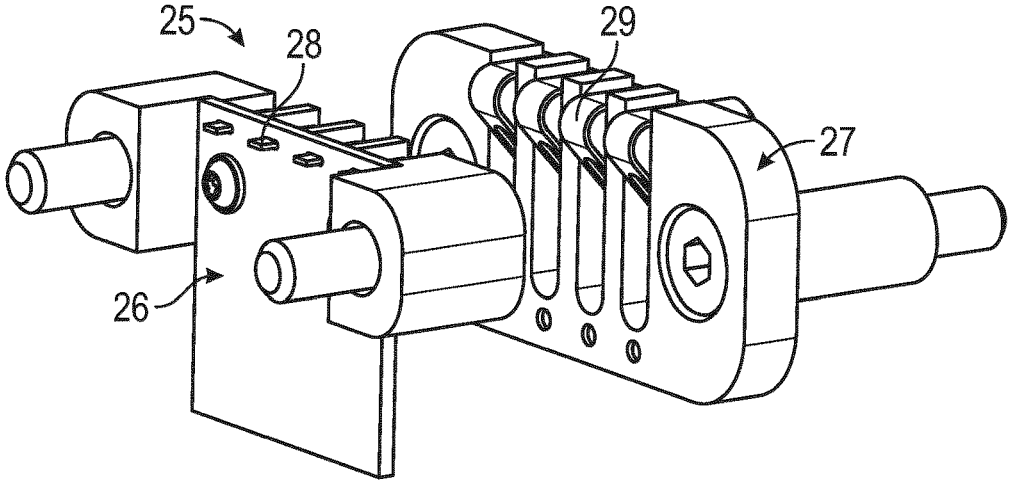
FIG. 12 is a perspective view illustrating a first and a second connector part of the pattern plate and the pressing plate, respectively, of FIG. 7.

Each connector part 26, 27 includes a number of electrical contact elements 28, 29, and the electrical contact elements 29 of the second connector 27 part are adapted to flexibly engage and slide on a top side 42 of the respective electrical contact elements 28 of the first connector part 26 during a mounting operation whereby the pattern plate 6 is mounted on the sand moulding machine 2. During the mounting operation, as illustrated in FIG. 10, the pattern plate 6 is brought into engagement with the heating plate 41 and is mounted thereon by means of bolts, whereby the electrical contact elements 29 of the second connector 27 engage the respective electrical contact elements 28 of the first connector part 26 and slide on a top side 42 thereof. Thereby, any sand or dust present on the electrical contact elements 28, 29 will be wiped away and good electrical contact may be established between the electrical contact elements 28, 29. In this way, a stable network connection may be established between each of the sand mould identification devices 7 and the controller 13.

Figure 3:
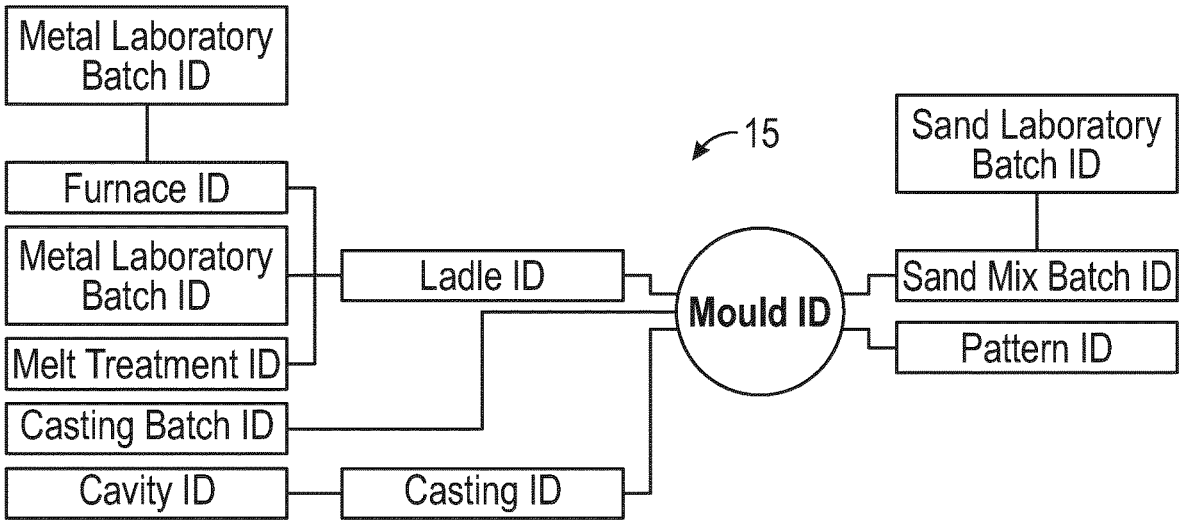
FIG. 3 is a diagram illustrating a computer controlled database system of the foundry production line of FIG. 1.

Referring to FIG. 3, preferably, the computer controlled database system 15 is adapted to store a data set corresponding to each individual identification pattern (Casting ID), each said data set including production variables measured, set or detected during production related to said individual identification pattern. Each said data set may include at least the following data: a casting identification (Casting ID) corresponding to the detected individual identification pattern, quality data for the finished casting 19 indicating at least whether the casting is acceptable or not, sand test data in the form of compactability and green compression strength, metal data in the form of a chemical analysis of metal in furnace and/or ladle, melt pouring device data in the form of pouring temperature, and sand moulding machine data in the form of mould compressibility.

Furthermore, the computer controlled database system 15 may be adapted to store some or all of the following process parameters or even more:

Sand plant (Data per batch of sand, may be equal to approximately 20 times per hour):

- Sand Mix batch ID
- Recipe (Return sand, New sand, Bentonite, Coal dust, Water etc.)
- Mixing time
- Actual additions (Return sand, New sand, Bentonite, Coal dust, Water etc.)
- Compressibility
- Sand strength
- Maximum amperes used by mixer
- Sequence and amounts of additions Sand Laboratory (Data per manual conducted sand test, may be equal to approximately 1-6 times per day):

- Sand Laboratory batch ID
- Average grain size
- Green compression strength
- Permeability
- Compactability
- Moisture content
- Active clay content (Methylene blue)
- AFS clay content
- Loss on ignition
- Grain size distribution
- Green tensile strength
- Spalling strength
- Wet tensile strength
- Temperature
- Return sand moisture
- Return sand temperature
- Time sand is resting in return sand hopper Melt Deck (Data per furnace liquid metal, may be equal to approximately 0.5-1 time per hour):

- Furnace ID
- Recipe (Internal returns, pig iron, steel scrap, alloying elements, etc.)
- Chemical analysis
- Thermal analysis Metal Laboratory (Data for furnace and ladles, frequency accordingly):

- Metal Laboratory batch ID
- Chemical analysis
- Thermal analysis

Melt Handling/Treatment (Data per ladle of liquid metal, may be equal to approximately 4-8 times per hour):

- Melt Treatment ID
- In case of Magnesium treatment: Time of treatment
- In case of Magnesium treatment: Time of transfer into pouring unit
- In case of Magnesium treatment: Recipe for treatment
- Recipe for treatment
- Temperature Moulding Line—Process relevant data (Data per mould, may be equal to up to approximately 555 times per hour):

- Mould ID
- Pattern ID
- Compressibility
- Machine settings (Squeeze pressure, Shot pressure, Pattern stripping, etc.)
- Mould ok/not ok
- Traceability data (Data per casting, may be equal to up to approximately 5000 times per hour or more)
- Casting ID Moulding Line—Production relevant data (Data per mould, may be equal to up to approximately 555 times per hour):

- Mould ID
- Moulding speed
- All operational parameters of the moulding line (pressure profiles, times, speed profiles, signals, set points, feedbacks, etc.)

Dimensional Mould Data (Data per mould, may be equal to up to approximately 555 times per hour):

- Mould ID
- Mismatch
- Mould gaps
- Parallelism
- Mould steps

Pouring Unit (Data per mould, may be equal to up to approximately 555 times per hour. Chemical analysis's per ladle)

- Mould ID
- Pouring temperature
- Pouring time
- Chemical analysis (For SG and Vermicular iron: Start+End of each Ladle)
- Mould poured/Not poured
- Pouring sequence ok/not ok
- Inoculation ok/not ok
- Pour box level
- Thermal analysis In-mould cooling of castings (Data per mould, may be equal to up to approximately 555 times per hour):

- Mould ID
- In-mould cooling time
- Casting/Sand cooling:
- Sand Mix batch ID
- Casting ID
- Sand temperature
- Casting temperature
- Return sand:
- Sand Mix batch ID
- Sand temperature
- Water addition
- Moisture content Quality Data (Data per casting, may be equal to up to approximately 5000 times per hour or more):

- Casting ID
- Casting ok/not ok. In case not ok: Type of defect

The above-mentioned process parameters are measured continuously or discretely by means of suitable, known automatic or manual measuring devices.

In a method of operating a foundry production line 1 according to the present invention, sand moulds 36 are produced in the sand moulding machine 2, melt is poured into the sand moulds 36 in the melt pouring device 3, and sand moulds 36 are broken apart and castings are taken out in the shakeout machine 4. In the moulding chamber 5 of the sand moulding machine 2, the pattern plates 6, 52 form respective patterns in a sand mould part 37 during compaction of the sand mould part in the moulding chamber 5. The sand mould identification device 7 provides an identification pattern in each sand mould 36 before melt is poured into the sand mould 36 so that each sand mould 36 formed by two sand mould parts 37 is provided with at least one individual identification pattern which subsequently forms a corresponding individual identification pattern in each resulting casting 19. The castings 19 are cleaned in the finishing apparatus 18, and the castings 19 are inspected in the inspection station 20 after being cleaned in the finishing apparatus 18. The automatic image detection system 14 detects the resulting individual identification patterns in at least some of the castings 19, and the computer controlled database system 15 stores data relating to a number of production variables being measured and/or set during production and data relating to the quality of the produced castings. The imaging device 21 of the automatic image detection system 14 is arranged in the inspection station 20 and provides a 2D digital image of the individual identification pattern formed in at least some of the cleaned castings 19, and the computer system of the automatic image detection system 14 runs a computer program developed by means of machine learning and thereby analyses the provided 2D digital images and detects the individual identification patterns of the respective cleaned castings 19.

Preferably, the sand mould identification device 7 impresses an identification pattern in a sand mould part 37 during its compaction. Alternatively or additionally, the sand mould identification device 7 may be arranged in a core shooting machine 60 to imprint an identification pattern in a core which is placed in the sand mould before pouring melt into the sand mould. In this case, the core may form part of the sand mould, and thereby the castings may be marked with individual identification patterns in the same way as when the sand mould identification device 7 impresses an identification pattern in a sand mould part 37 during its compaction.

Preferably, the 2D digital image of the individual identification pattern formed in a cleaned casting 19 is provided by means of a handheld device 23 held by and operator.

Preferably, before, after, or simultaneously with the imaging device 21 providing the 2D image of the individual identification pattern of a finished casting 19, the operator inputs quality data for the finished casting to the computer controlled database system 15 by means of the interface provided on the handheld device 23, and the quality data for the casting 19 indicates at least whether the casting is acceptable or not and possibly indicates a type of deficiency of the finished casting.

The foundry production line 1 may include at least a data output system including a computer monitor adapted to present data collected in the computer controlled database system 15 for evaluation. The evaluation of data may be performed more or less manually, using software tools, or, furthermore, the foundry production line 1 may include a data analysing unit 61 adapted to automatically perform an entire analysis or part of an analysis of data collected in the computer controlled database system 15. The automatic analysis of data may possibly be performed by using artificial intelligence. The results of the automatic analysis of data may be presented by means of a data output system including a computer monitor 62. In this way, by analysing data and finding correlations between defectives and process parameters, it may be possible to determine the root causes for deficient castings and thereby bring down quality costs. For instance, if 100 castings have been categorised as having the same cause of deficiency, for instance porosities or sand inclusions, stored data sets relating to these castings may be analysed in order to possibly find similarities in process parameters which could have caused the deficiencies.

LIST OF REFERENCE NUMBERS

1 foundry production line
2 sand moulding machine
3 melt pouring device
4 shakeout machine
5 moulding chamber of sand moulding machine
6 first pattern plate
7 sand mould identification device
8, 9, 10 individually adjustable indicator element of sand mould identification device
11 rotationally arranged cylindrical element
12 end of rotationally arranged cylindrical element
13 controller
14 automatic image detection system
15 computer controlled database system
16 rounded edges of individually adjustable indicator element
17 direction of individually adjustable indicator element
18 finishing apparatus
19 casting
20 inspection station
21 imaging device
22 stationary alignment element
23 handheld device
24 interface of handheld device
25 connector
26 first connector part
27 second connector part
28 electrical contact element of first connector part
29 electrical contact element of second connector part
30 sand and casting cooler
31 green sand storage and preparation unit
32 sand elevator
33 screen
34 silo
35 sand mixer
36 sand mould
37 sand mould part
38 sand mould conveyor
39 return sand conveyor
40 sand conveyor
41 heating plate of sand moulding machine
42 top side of electrical contact element of first connector part
43 pressing plate of sand moulding machine
44 swing plate of sand moulding machine
45 piston for pressing plate
46 swing arm for swing plate
47 pivot axis for swing plate
48 pattern of pattern plate
49 sand filling opening of sand moulding machine
50 front side of pattern plate
51 back side of pattern plate
52 second pattern plate
53 housing of sand mould identification device
54 relatively broad, partly circular part of individually adjustable indicator element
55 relatively narrow, elongated part of individually adjustable indicator element
56 network cable
57 network card
58 handle of handheld device
59 screen of handheld device

60 core shooting machine
61 data analysing unit
62 data output system

The invention claimed is:

1. A foundry production line including a sand moulding machine, a melt pouring device, and a shakeout machine for breaking apart sand moulds and taking out castings, the sand moulding machine including at least one moulding chamber in which at least one pattern plate is adapted to form a pattern in a sand mould part during compaction of the sand mould part in the at least one moulding chamber, at least one pattern plate being provided with at least one sand mould identification device including a plurality of individually adjustable indicator elements adapted to impress an identification pattern in the sand mould part during its compaction, each individual indicator element being formed at an end of a rotationally arranged cylindrical element, a rotational position of each individual indicator element about an axis of rotation of the corresponding cylindrical element being adjustable by means of an actuator being controlled by a controller adapted to provide each sand mould formed by two sand mould parts with at least one individual identification pattern arranged to form a corresponding individual identification pattern in a resulting one of the castings, the foundry production line including an automatic image detection system adapted to detect the resulting individual identification patterns in the castings, and the foundry production line including a computer controlled database system adapted to store data relating to a number of production variables measured and/or set during production and data relating to the quality of the produced castings, wherein each individually adjustable indicator element is formed with rounded edges and is formed to indicate a direction along a diameter of the corresponding cylindrical element on which it is arranged, wherein the foundry production line includes a finishing apparatus adapted to clean the castings and an inspection station for inspection of the castings being arranged after the finishing apparatus in a transport direction of the castings, wherein the automatic image detection system includes an imaging device arranged at the inspection station, wherein the imaging device is adapted to provide a digital image of a particular one of the individual identification patterns formed in a cleaned one of the castings, and wherein the automatic image detection system includes a computer system adapted to run a computer program developed by means of machine learning to analyse the digital image and thereby detect the particular individual identification pattern of the cleaned casting.

2. A foundry production line according to claim 1, wherein the computer system is adapted to validate correctness of the detected individual identification pattern of the cleaned casting.

3. A foundry production line according to claim 2, wherein the imaging device is included in a handheld device or a stationary device, and wherein the handheld device or the stationary device includes an interface for reading out an estimate of accuracy of the performed detection of the individual identification pattern.

4. A foundry production line according to claim 1, wherein the at least one sand mould identification device includes a number of stationary alignment elements adapted to impress an alignment pattern in the sand mould part during its compaction, and wherein the automatic image detection system is adapted to, before detection of the particular individual identification pattern in the cleaned casting, align the digital image with a reference image of the alignment pattern.

5. A foundry production line according to claim 4, wherein the rotationally arranged cylindrical elements are arranged side by side along a line, and wherein the stationary alignment elements are arranged asymmetrically about said line.

6. A foundry production line according to claim 1, wherein each individual indicator element extends at least 0.5 millimetres.

7. A foundry production line according to claim 1, wherein the controller is adapted to control the actuator corresponding to each individual indicator element so that the individual indicator element may be positioned in at least 15 different rotational positions about the axis of rotation of the cylindrical element, and wherein the computer controlled database system is adapted to store each of such distinctive rotational positions of the individual indicator element as belonging to a corresponding distinctive individual identification pattern to be formed in a casting.

8. A foundry production line according to claim 1, wherein the imaging device is included in a handheld device.

9. A foundry production line according to claim 1, wherein the imaging device is included in a stationary device mounted at the inspection station.

10. A foundry production line according to claim 1, wherein the imaging device is included in a handheld device or a stationary device, wherein the handheld device or the stationary device includes an interface for input of quality data for a finished casting to the computer controlled database system, wherein the quality data relates to the cleaned casting of which the imaging device provides a digital image of the individual identification pattern formed in the casting, and wherein the quality data for the casting indicates at least whether the cleaned casting is acceptable or not.

11. A foundry production line according to claim 1, wherein the finishing apparatus is adapted to clean castings by means of blasting.

12. A foundry production line according to claim 1, wherein the at least one pattern plate is provided with one or more sand mould identification devices connected to the controller by means of a single connector including a first connector part arranged on the pattern plate and a second connector part arranged on the sand moulding machine, wherein each connector part includes a number of electrical contact elements, and wherein the electrical contact elements of the second connector part are adapted to flexibly engage and slide on a top side of the respective electrical contact elements of the first connector part during a mounting operation of the pattern plate on the sand moulding machine.

13. A foundry production line according to claim 1, wherein the computer controlled database system is adapted to store a data set corresponding to each individual identification pattern, each said data set including production variables measured and/or set during production related to said individual identification pattern.

14. A foundry production line according to claim 13, wherein each said data set includes at least the following data: a casting identification (ID) corresponding to the detected individual identification pattern, quality data for the cleaned casting indicating at least whether the cleaned casting is acceptable or not, sand test data, metallurgical data, and melt pouring data.

15. A foundry production line according to claim 13, wherein each said data set includes at least the following data: a casting identification (ID) corresponding to the detected individual identification pattern, quality data for the cleaned casting indicating at least whether the cleaned casting is acceptable or not, sand test data in the form of compactability and green compression strength, metallurgical data in the form of a chemical analysis of metal in furnace and/or ladle, melt pouring device data in the form of pouring temperature, and sand moulding machine data in the form of mould compressibility.

16. A method of operating a foundry production line, whereby sand moulds are produced in a sand moulding machine, melt is poured into the sand moulds in a melt pouring device, and sand moulds are broken apart and castings are taken out in a shakeout machine, the sand moulding machine including at least one moulding chamber in which at least one pattern plate forms a pattern in a sand mould part during compaction of the sand mould part in the moulding chamber, at least one sand mould identification device including a plurality of individually adjustable indicator elements providing a corresponding identification pattern in each sand mould before melt is poured into the sand mould, each individual indicator element being formed at an end of a rotationally arranged cylindrical element, a rotational position of each individual indicator element about an axis of rotation of the corresponding cylindrical element being adjusted by means of an actuator being controlled by a controller so that each sand mould formed by two sand mould parts is provided with at least one individual identification pattern which subsequently forms a corresponding individual identification pattern in a resulting casting, whereby an automatic image detection system detects the resulting individual identification patterns in at least some of the castings, and whereby a computer controlled database system stores data relating to a number of production variables being measured and/or set during production and data relating to the quality of the produced castings, wherein each individually adjustable indicator element is formed with rounded edges and indicates a direction along a diameter of the corresponding cylindrical element on which it is arranged, wherein the castings are cleaned in a finishing apparatus, wherein the castings are inspected in an inspection station after being cleaned in the finishing apparatus, wherein an imaging device of the automatic image detection system is arranged in the inspection station and provides a digital image of the individual identification pattern formed in at least some of the cleaned castings, and wherein a computer system of the automatic image detection system runs a computer program developed by means of machine learning and thereby analyses the provided digital images and detects the individual identification patterns of the respective cleaned castings.

17. A method of operating a foundry production line according to claim 16, wherein the computer system validates correctness of the detected individual identification pattern of the cleaned casting.

18. A method of operating a foundry production line according to claim 16, wherein the at least one sand mould identification device impresses an identification pattern in the sand mould part during its compaction.

19. A method of operating a foundry production line according to claim 16, wherein the digital image of the individual identification pattern formed in at least one of the cleaned castings is provided by means of a handheld device held by an operator or by means of a stationary device operated by an operator.

20. A method of operating a foundry production line according to claim 19, wherein, before, after, or simultaneously with the imaging device providing the digital image of the individual identification pattern of the at least one of the cleaned castings, the operator inputs quality data for the finished casting to the computer controlled database system by means of an interface provided on the handheld device or on the stationary device, and wherein the quality data for the at least one of the cleaned castings indicates at least whether the at least one of the cleaned castings is acceptable or not.

21. A method of operating a foundry production line according to claim 19, wherein the operator receives an estimate of accuracy of the performed detection of the individual identification pattern by means of an interface provided on the handheld device or on the stationary device.

22. A method of operating a foundry production line according to claim 16, wherein the computer controlled database system stores a data set corresponding to each individual identification pattern, and wherein each said data set includes production variables being measured and/or set during production and being related to said individual identification pattern.

* * * * *